United States Patent [19]

Metelko, Jr.

[11] Patent Number: 4,704,764

[45] Date of Patent: Nov. 10, 1987

[54] ASH DISPOSAL DEVICE

[76] Inventor: Rudy R. Metelko, Jr., 448 South 300 West, Price, Utah 84501

[21] Appl. No.: 755,934

[22] Filed: Jul. 16, 1985

[51] Int. Cl.[4] ..... F23J 1/00

[52] U.S. Cl. ..... 15/301; 15/327 R; 15/352; 15/353; 126/242

[58] Field of Search ..... 126/242; 15/352, 301, 15/310, 327 R, 353; 55/429, 434, 462, 465, 472

[56] References Cited

U.S. PATENT DOCUMENTS

| | | | |
|---|---|---|---|
| 1,679,856 | 8/1928 | Ditsch et al. . | |
| 1,765,871 | 6/1930 | Johnson | 126/242 |
| 1,785,481 | 12/1930 | Dyke . | |
| 1,936,527 | 11/1933 | Shellcrosslee | 126/242 |
| 2,013,498 | 9/1935 | McConaughy | 15/310 X |
| 2,529,965 | 11/1950 | Rentz | 126/242 |
| 2,649,927 | 8/1953 | Ortega | 15/353 X |
| 3,018,504 | 1/1962 | Hart | 15/353 X |
| 4,358,300 | 11/1982 | Schlapman et al. | 15/353 X |
| 4,363,417 | 12/1982 | Rhoades et al. | 220/1 T |
| 4,476,608 | 10/1984 | Rasmussen | 15/353 |
| 4,497,308 | 2/1985 | Johnson | 15/327 F X |
| 4,571,250 | 2/1986 | Irmscher et al. | 55/429 X |

*Primary Examiner*—Chris K. Moore

*Attorney, Agent, or Firm*—Workman, Nydegger & Jensen

[57] ABSTRACT

A dustless container for disposing of ash generated by wood or coal burning stoves, fireplaces and furnaces. The container may be of any shape desired, however, a conventional twenty-gallon garbage can and lid has been found acceptable. A door is disposed in the side of the container so that ash may be shoveled through the door into the interior of the container. The lid is provided with an opening which is covered with a vacuum adaptor. A conventional vacuum cleaner can then be attached to the vacuum adaptor. A baffle is disposed within the interior of the lid so that suction provided by the vacuum cleaner is evenly dispersed within the container. Thus, any fine fly ash which floats upwardly as ash is loaded into the container will be drawn through the lid and into the vacuum cleaner and will not re-enter the room surrounding the container.

7 Claims, 5 Drawing Figures

ASH DISPOSAL DEVICE

BACKGROUND

1. Field of the Invention

The present invention is related to a device for receiving ashes, and in particular, to a container having an attachment adaptable for accepting a suction source for assuring that the dust from ashes placed in the container do not re-enter a room.

2. The Prior Art

The current invention deals with the age old problem of removal of ashes after certain fuels have been burned. When wood or coal are burned in a fireplace or stove located within a building, it is necessary at some point to remove the ashes produced from that combustion. Components of the ash produced from the burning of such fuels may vary in size from very small to quite large. Indeed, it is not unusual for ash produced by burning wood, coal and other similar fuels to contain a large component of very fine particles. It will be appreciated, that removal of these very fine particles of ash dust, from a building may be difficult given the tendency of such particles to float upwardly and enter the surrounding building.

The problem of ash entering a building reached a peak during the time that coal and wood burning furnaces were commonly used as the exclusive source of heat in houses and other buildings. The volume of ash produced by such a coal or wood burning furnace was very large, giving rise to a correspondingly large problem in removing that material from the building. In particular, it was not uncommon for ash dust to coat the furnishings, floor coverings, walls and other items located within a building using a coal or wood burning furnace.

In recent years the problem has again developed. With the rapid increase in the price of fuels used for heating, such as electricity and natural gas, many people have again looked to coal and wood burning stoves and furnaces as heat sources. In recent years the use of small stoves of this type has gained wide acceptance for room heating. As a result, ash removal, and particularly, ash dust removal, has again become a serious and annoying problem.

Various prior art devices have been developed to aid in the removal of ash from coal and wood burning furnaces, fireplaces and stoves. The most popular and widely used method of removing ash is simply to shovel the ash into a bucket of some type and then carry the bucket outside of the building for disposal of the ash. It was found, however, that when the ash was shoveled into the bucket, fine ash dust had a tendency to fly upwardly into the surrounding room. This was a particular problem when removing ash from a fireplace or wood stove located in the living area of a house or other residential building. The ash would simply leave the ash bucket and travel into the room where it would coat the furnishings and other objects contained within the house.

In an attempt to solve some of the problems associated with ash entering a building, various types of hoods and other containers have been developed. For example, ash containers have been developed which include their own chimney. In using these containers, ashes are shoveled into a container which is essentially covered with the exception of a door. Since the container is fully covered, the ash will not re-enter the room. Such devices were provided with their own chimneys whereby the fine fly ash was able to exit the building without entering the living area.

A later variation of the device described above included attachment of the ash hood to the chimney system already existing in the building. Essentially, an ash bin was placed adjacent to a coal or wood burning furnace and the top of the ash bin was placed in communication with the furnace's chimney. As a result, ash could be shoveled from the furnace into the ash bin and the fine ash particles, which would otherwise enter the building, were directed through the furnace's chimney.

A problem which remained in the use of this device was that ash would enter the room while it was being transported from the furnace to the ash container. As a result, a refinement of the device was developed which included an ash hood disposed directly over the entrance to the furnace. Ash dust which would otherwise enter the building when ashes are shoveled from the furnace is caught by the expanded ash hood system. Like the device described above, however, ash was simply placed in a ash bin which was then placed in communication with the main furnace flue.

Other more compact devices have also been developed. For example, one device employs an electric fan which is placed in communication with an ash bucket. The electric fan draws air up from the ash bucket and forces that air into a tube which is placed in communication with the furnace's flue. As a result, it was anticipated that fly ash shoveled into the bucket would be drawn upwardly by the fan into the tube and then discharged into the furnace's flue. Thus, the small ash particles could be removed without allowing them to enter the surrounding building.

One problem encountered with this device, however, was that the fan only covered a portion of the top of the ash bucket. Ash particles were found to make their way out of the bucket without being drawn through the fan. In addition, it was necessary to shovel the ash into the top of the bucket. This maneuver was complicated by the fact that the fan rested on the top of the bucket. As a result, it was necessary to shovel the ash past the fan in order for it to reach the bucket.

It will be readily appreciated that none of the devices mentioned above are particularly useful for small applications. It is contemplated that most of the prior art devices be used with a central furnace system. The ash removed by the ash removal device is typically directed into the central furnace system's chimney or flue for removal. In addition, most of the prior art devices discussed above are simply methods of placing a cover over a conventional bucket. It would be difficult to use such a system in connection with a small fireplace or room heating stove.

In response to some of the problems outlined above, additional devices have been developed which are more portable and feasible for use in connection with individual fireplaces and room heating stoves. These devices typically employ a traditional ash bucket having some type of lid which at least partially prevents the ash from readily entering the surrounding room. For example, one such ash bucket includes a chute in the side of the bucket through which ash can be shoveled. While ash is being shoveled into the bucket, however, the top of the bucket remains shut. As a result, the bucket is able to contain some of the ash which would otherwise flow into the room. Even using this type of device, however, some quantity of ash is very likely to float back out of the container while the container is being loaded. No provision is made, for example, for assuring that ash which enters the containers stays within the container while the container is being loaded.

It is apparent that what is currently needed in the art is a portable, yet effective container for removing ash from coal or wood burning furnaces or stoves. It would be an advancement in the art to provide such a device which could be used in connection with small room heating furnaces and stoves and individual fireplaces. It would also be an advancement in the art if such a device were relatively small and light and was capable of being carried into and out of the room or building as necessary. It would be an advancement in the art if such a device could use suction in order to remove ash without the necessity of being connected to the building's ventilation or chimney system. Such an apparatus is disclosed and claimed herein.

BRIEF SUMMARY AND OBJECTS OF THE INVENTION

The present invention is directed to a novel and unique container for receiving fireplace ash. In addition to providing a container for the ash, the current invention is provided with means for connecting the interior of the container to a vacuum cleaner or other suction means. As a result, the current invention is much more effective in keeping fine fly ash from re-entering a room.

The current invention may be constructed of any type of enclosed container. The container may be cylindrical, cubicle or take on any type of other desired configuration. However, it has been found that one acceptable container is a conventional twenty-gallon garbage can which has been modified according to the teachings of the current invention.

The current invention includes a door mounted in the side of the container. The door may be in the configuration of a chute such that any ashes which are shoveled in through the door will be directed into the interior of the container. The door may be mounted on the container in any conventional manner. One method of mounting includes an axle which is securely mounted to the door and also to the body of the container such that the door may pivot around the axle.

It is anticipated that the current invention will have an attachment disposed in the lid or upper surface of the container for receiving a conventional vacuum cleaner hose. In addition, the lid or upper surface of the container is modified so that the suction provided by such a vacuum cleaner hose will be spread over a more uniform area within the interior of the container.

Before placing the container into operation a source of suction will be attached to the attachment in the upper surface or lid of the container. As a result, any ash which would otherwise fly into the room will be directed upwardly within the container and drawn into the source of suction, such as a conventional vacuum cleaner. The source of suction is baffled so that suction is evenly dispersed within the container. In addition, the device may include a filter so that large, hot particles are not drawn into the suction source.

In operation, the door, which is in the configuration of a chute, will be pulled open. Ashes or other similar material may be then shoveled into the container through the door. Since the door is formed in the shape of a chute the ashes will slide into the the interior of the container rather than being allowed to fill the outside edges of the container or possibly fall onto the floor of the surrounding room. Consequently, the bulk of the ashes is deposited within the container and the problem of flying ash floating into the surrounding room is virtually eliminated.

It is, therefore, a primary object of the present invention to provide an ash container apparatus which minimizes the chances for ashes and fly ash to leave the container.

It is a further object of the present invention to provide an apparatus which is portable, relatively small and easy to carry into or out of the room as necessary.

Another object of the present invention is to provide an apparatus which is capable of being connected to generally available sources of suction such as conventional vacuum cleaners.

Another object of the current invention is to provide an apparatus for removal of ash which includes a door configured in the form of a chute so that ash is directed into the interior of the container while loading.

Other objects and advantages of the invention will become apparent in view of the following detailed description and appended claims and upon reference to the accompanying drawings.

DETAILED DESCRIPTION OF THE PREFERRED EMBODIMENTS

Figure 1:
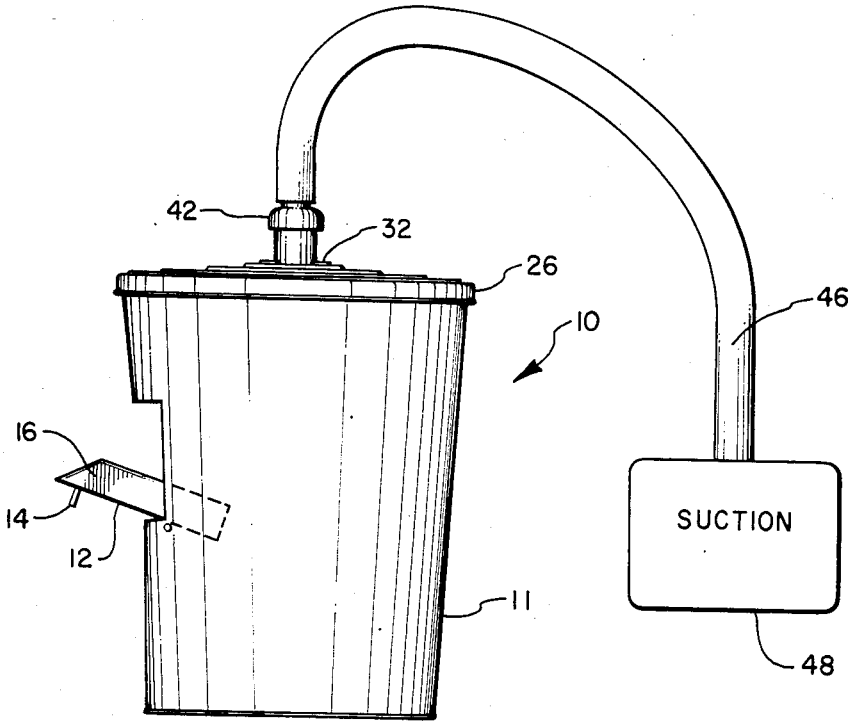
FIG. 1 is a side elevational view of one embodiment of the current invention.

The present invention can be best understood by reference to the drawings, wherein like parts are designated with like numerals throughout. Referring particularly to FIG. 1, one embodiment of the present invention is directed to an apparatus for aid in the removal of ash from coal or wood burning fireplaces, furnaces or stoves. The container of the current invention is generally designated 10. The container 10 includes a lid 26, a door 12, a vacuum adaptor 30 and a body generally designated 11. The current invention is particularly adaptable to be placed in communication with a conventional source of suction, such as a household vacuum cleaner. As a result, ash which would otherwise tend to fly into the room is drawn through the container of the current invention into the vacuum cleaner.

Container 10 may be constructed in any of a number of configurations. For example, the container may be generally cylindrical, it may be generally cubicle or may have any other type of desired configuration. It may be desirable to construct container 10 in a particular way for decorative purposes. It will be appreciated with reference to the remainder of the description below, that the particular configuration of container 10 is not critical to the operation of the device. One type of container 10 which has been found to be acceptable is a conventional twenty-gallon garbage can with a lid. The conventional garbage can and lid are modified according to the teachings of the current invention in order to construct the current device.

As can be seen with reference to FIG. 1, the container 10 of the current invention is provided with a door 12. It is expected that it will be preferred for door 12 to be placed in the side of the body 11 of container 10. Door 12 is constructed and mounted on the body 11 such that when it is pulled open using handle 14, the upper portion of door 12 extends outwardly into the room surrounding container 10. In addition, door 12 may be provided with upwardly extending sides 16. Sides 16 along with the outer portion of door 12 form a chute. This chute is particularly adaptable for receiving, for example, a shovel full of ashes. As can be appreciated from FIG. 1, the chute formed by door 12 and upwardly extending sides 16 will direct the ash well within the interior of container 10. As a result, it is unlikely that any ash will be spilled outside of the container or allowed to fly into the surrounding room. Once the ash is loaded within container 10 it is a simple matter to press upwardly on handle 14 in order to close door 12.

Figure 2:
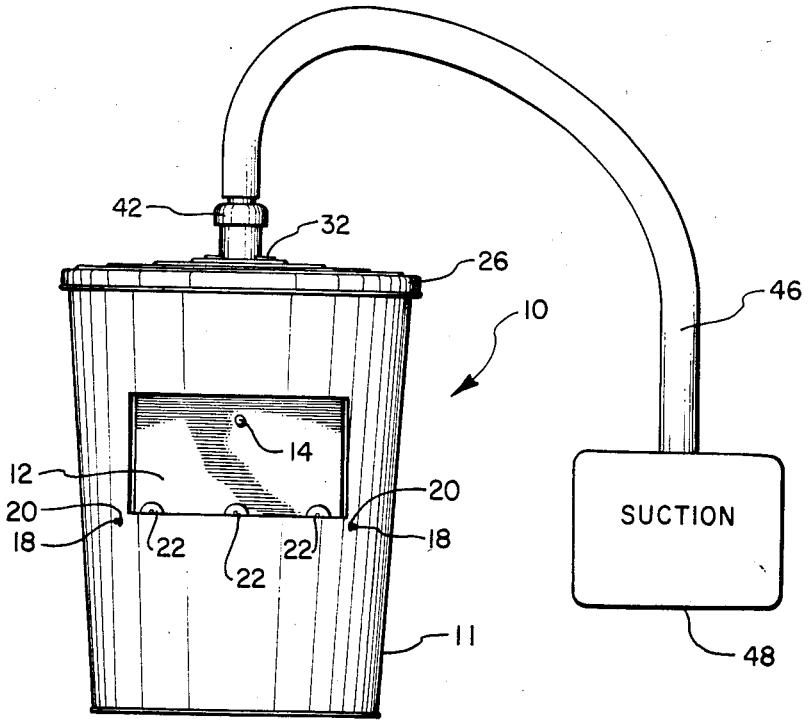
FIG. 2 is a front elevational view of the embodiment of the current invention illustrated in FIG. 1.

As mentioned above, door 12 may be mounted to the body 11 of container 10 in any conventional manner. As illustrated in FIG. 2, one method of mounting includes an axle 18 which is attached to both container 10 and door 12. Axle 18 is allowed to protrude through two openings 20 in the sides of container 10. Axle 18, in turn, is secured to door 12 through a plurality of metal pieces 22 which are secured by a plurality of rivets or other conventional means of attachment. This method of attachment allows door 12 to be easily pivoted inwardly and outwardly as necessary. It also provides for closing door 12 immediately after loading ash into container 10 so as to prevent fine fly ash from leaving the container 10.

An additional important structural feature of the current invention is the upper portion, or lid 26, of container 10. As illustrated in FIGS. 1 and 2 it may be possible to simply use a conventional garbage can lid for the basic structure of lid 26. In any event, it is necessary that lid 26 fit securely over the top of the body 11 of container 10. Any type of conventional lid modified as described below may be acceptable for the current purposes.

Figure 3:
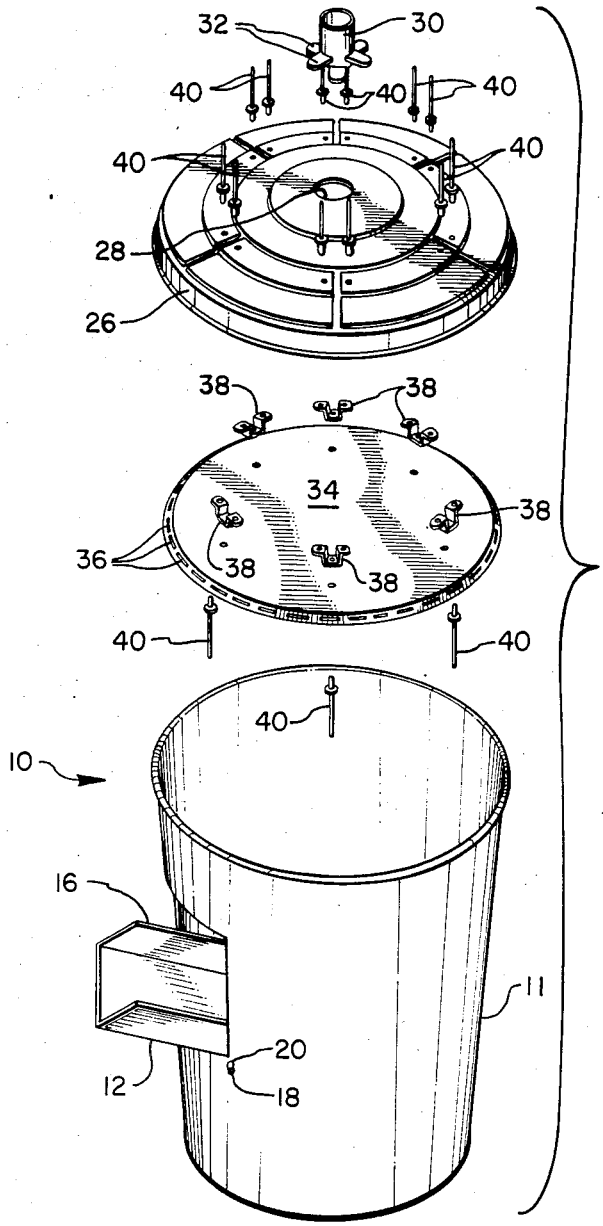
FIG. 3 is an exploded perspective view of the container of the current invention illustrating some of the various component parts comprising the device.

FIG. 3 best discloses the structure of modified lid 26. FIG. 3 comprises an exploded view of the various parts of the lid 26. In order to modify lid 26, an opening 28 is formed in the top of lid 26. Over the top of opening 28 is placed a tube 30. Tube 30 is attached to lid 26 in any conventional manner such as by the use of rivets or with the use of a plurality of flanges as shown in FIG. 3. A vacuum adaptor 42 may then be placed over tube 30. The preferred construction of vacuum adapter 42 is illustrated in more detail in FIG. 4 and will be described further below.

Lid 26 is also modified by the attachment of an air baffle 34. Air baffle 34 is constructed so that it may fit into the top of lid 26 as illustrated in FIG. 3, leaving a gap between the outer edge of air baffle 34 and the inner diameter of lid 26. This opening may be approximately 1/8 inch across and will run the entire circumference of air baffle 34. As an alternative, air baffle 34 may be provided with slots 36 along its outer edge. It will be appreciated that the purpose of air baffle 34 is to deflect the suction toward the outside of container 10, rather than allowing all of the suction to be directed through the center of the container 10.

Air baffle 34 may be connected to lid 26 in any conventional manner. In the embodiment illustrated in FIG. 3, air baffle 34 is spaced from lid 26 by the use of a plurality of spacers 38. Spacers 38 are disposed between air baffle 34 and lid 26 in order to allow air to travel between air baffle 34 and lid 26. Air baffle 34 may be connected to spacers 38, which may then be connected to lid 26, in any conventional manner. For example, a plurality of rivets or screws 40 may be acceptable for making the attachments.

Once lid 26 is modified as described above, it is capable of being securely fit onto the top of container 10. When connected to a source of suction, air will be able to flow upwardly through the container, around the edge or through the slots 36 of air baffle 34, upwardly to lid 26, and finally out opening 28 through tube 30.

Figure 4:
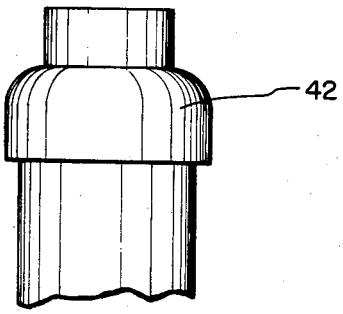
FIG. 4 is a cutaway side elevational view of one embodiment of the vacuum connector used in the current invention.

Vacuum adaptor 42 is illustrated in more detail in FIG. 4. It will be appreciated that it may be desirable to construct vacuum adaptor 42 in such a way that a conventional vacuum cleaner may be attached. Thus, vacuum adaptor 42 is constructed so as to receive securely the hose of a conventional vacuum cleaner or other suction source 48. Vacuum adaptor 42 is then placed over the tube 30, which is in turn secured to the device over opening 28.

Figure 5:
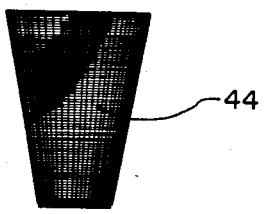
FIG. 5 is a side elevational view of a filter which may be positioned within the vacuum connector of the current invention.

It may also be desirable to dispose a filter means between the suction source 48 and the interior of the device. It may be necessary to filter out some large particles and also to filter out any hot embers or hot ash that may travel upwardly through the device. As a result, FIG. 5 illustrates the structure of a filter 44 which may be disposed within the interior of vacuum adaptor 42. Filter 44 may be a fine screen mesh in the shape of a truncated cone. The truncated conical filter 44 is then placed within the vacuum adaptor 42 with the narrow end facing downwardly. The wide end of the filter 44 extends upwardly toward the upper portion of vacuum adaptor 42.

The operation of container 10 can be easily understood with reference to the drawings. When it is desired to remove ash from a coal or wood burning fireplace, furnace or stove, one end of a conventional vacuum cleaner hose 46 may be attached to vacuum adaptor 42 and the other end will be secured to the vacuum or other suction source 48. The suction source 48 will then be turned on to provide suction for device 10.

Once the suction is established, door 12 may be opened using handle 14. At this point, ash and other waste materials from a fireplace, stove or furnace may be shoveled into device 10 through door 12. Since door 12 is constructed in the form of a chute, all ash will be directed into the interior of container 10. As the ash reaches the interior of container 10 it is expected that the fine fly ash will tend to be disbursed upwardly. In the absence of the unique and inventive modifications to container 10, the fly ash would be able to again reach the exterior of container 10 as was the case with prior art devices.

Once the task of loading the ash into container 10 is completed, door 12 will again be shut. However, any fine fly ash which may rise from the bottom of container 10 will be drawn upwardly by the suction provided by the suction source 48. The fly ash will be drawn up around the edges of baffle 34 and finally up through vacuum adaptor 30 and out of the device through suction hose 46. Any large particles, however, such as hot embers, will be filtered out by filter 44. As a result, it is very unlikely that any of the fine fly ash will find its way back to the exterior of container 10.

It will be appreciated that the current invention provides a unique apparatus which is adaptable for the removal of ash from coal and wood burning fireplaces, stoves and furnaces. The current invention is portable being relatively small and light. It can easily be carried into a room to collect ash and then be removed from the room. It is not necessary to connect the container 10 to any permanent vent or chimney within the building. In addition, the current invention is able to employ a conventional vacuum cleaner to provide suction so that fine fly ash does not find its way out into the room surrounding container 10.

It will be appreciated that the apparatus and methods of the present invention are capable of being incorporated in the form of a variety of embodiments, only a few of which have been illustrated and described above. The invention may be embodied in other specific forms without departing from its spirit or essential characteristics. The described embodiments are to be considered in all respects only a illustrative and not restrictive. The scope of the invention is, therefore, indicated by the appended claims rather than the foregoing description. All changes which come within the meaning and range or equivalency of the claims are to be embraced within their scope.

What is claimed and desired to be secured by United States Letters Patent is:

1. An ash disposal apparatus comprising:

a generally cylindrical body having a base and an open upper end;

a lid configured so as to fit securely over the open upper end of the body, said lid having an opening disposed therein;

vacuum adaptor means defining an interior space, and being configured so as to securely cover the opening in the lid, and being capable of being placed in communication with a source of suction;

a frustoconical mesh filter disposed within the interior of the vacuum adaptor means, whereby said mesh filter filters out hot and cold particles which may flow into said vacuum adaptor means;

a door attached to the cylindrical body whereby access to the interior of the apparatus may be gained by opening said door and through which ash may be introduced into said container, said door being configured such that it forms a chute when opened;

a substantially planar and generally circular baffle disposed between the lid opening and the door such that air flowing between the open door and the lid opening must pass between the interior walls of the cylindrical body and the outside circumference of the baffle, such that an even airflow within the apparatus is achieved.

2. An ash disposal apparatus as defined in claim 1 further comprising suction means in communication with the vacuum adaptor means.

3. An ash disposal apparatus as defined in claim 1 wherein the suction means comprises a vacuum cleaner.

4. An ash disposal apparatus as defined in claim 1 wherein said lid is removable from the cylindrical body.

5. An ash disposal apparatus as defined in claim 1 wherein a suction hose is attached to the vacuum adaptor means.

6. An ash disposal apparatus as defined in claim 5 wherein the frustoconical mesh filter is disposed within said vacuum adaptor means in position such that hot ashes are prevented from leaving the cylindrical body and entering the suction hose.

7. An ash disposal apparatus as defined in claim 1 wherein the mesh filter comprises a wire mesh.

* * * * *